US006512460B1

(12) United States Patent
Prechel et al.

(10) Patent No.: US 6,512,460 B1
(45) Date of Patent: Jan. 28, 2003

(54) CHRISTMAS ORNAMENT

(76) Inventors: Oliver Prechel, 16950 Timberlakes Dr., Fort Myers, FL (US) 33908; Marco Prechel, 16950 Timberlakes Dr., Fort Myers, FL (US) 33908

( * ) Notice: Subject to any disclaimer, the term of this patent is extended or adjusted under 35 U.S.C. 154(b) by 0 days.

(21) Appl. No.: 09/646,914

(22) PCT Filed: Feb. 8, 2000

(86) PCT No.: PCT/IB00/00224

§ 371 (c)(1),
(2), (4) Date: Oct. 11, 2000

(87) PCT Pub. No.: WO00/47091

PCT Pub. Date: Aug. 17, 2000

(30) Foreign Application Priority Data

Mar. 29, 1999 (DE) ..... 299 05 767 U

(51) Int. Cl.[7] ..... G08B 17/10; G08B 21/00

(52) U.S. Cl. ..... 340/689; 340/628; 340/629; 340/632

(58) Field of Search ..... 340/628, 629, 340/630, 686.1, 689, 632

(56) References Cited

U.S. PATENT DOCUMENTS 4,075,614 A * 2/1978 White ..... 340/628
4,623,878 A 11/1986 Schoenwetter
5,396,221 A 3/1995 Bridges
5,821,865 A 10/1998 Solak
5,880,676 A 3/1999 Tsou
6,087,946 A * 7/2000 Menard, Jr. ..... 340/628

FOREIGN PATENT DOCUMENTS

GB 745 111 2/1956

OTHER PUBLICATIONS

International Search Report, Jun. 29, 2000, EPO.

* cited by examiner

*Primary Examiner*—Daniel J. Wu
(74) *Attorney, Agent, or Firm*—Shlesinger Arkwright & Garvey LLP

(57) ABSTRACT

Christmas ornament (10) for attaching to a Christmas tree, with a housing (12), which is preferably spherically shaped, the housing (12) being provided with a decorative outside, and at least one gas sensor (22), which, in case of detection of smoke, scorching or combustion gases triggers an acoustical and/or optical alarm (30, 26), the gas sensor (22) being arranged in the inside of the housing (12), the housing (12) being provided with gas inlet openings (24). Alternatively or additionally to the gas sensor (22) a position or inclination sensor (20) is arranged in the inside of the housing, which triggers an acoustical and/or optical alarm (30, 26) in case of a change of position or inclination of the Christmas ornament (10).

15 Claims, 2 Drawing Sheets

CHRISTMAS ORNAMENT

The invention concerns a Christmas ornament for attachment to a Christmas tree, comprising a housing, especially in form of a sphere, with a decorative outside.

Such Christmas ornaments include Christmas tree balls, also called Christmas balls, as well as other objects which are hung on a Christmas tree during the festive season.

Candles, which are annually hung on Christmas trees in closed spaces, due to their open fire, present a source of danger, as Christmas ornaments, especially the Christmas tree itself, as well as furniture objects in the closed spaces can easily catch fire. Furthermore, electric light chains and electric tree decorations present a danger of fire due to electric short circuits or overheating. Accidents involving Christmas trees are often caused by children or pets accidentally knocking over the tree. In case the tree falls over, fires can be caused not only due to wax candles with open fire, but also due to electric candles, which, after the tree has fallen over, can lead to a scorching of carpets. Even in case no direct danger of fire exists, a fallen over Christmas tree presents a source of danger for small children, as they can badly burn themselves on the hot electric candles, and even suffer electric injuries.

From DE 195 490 43 A1 there is known a fire alarm system in form of a Christmas ornament, in which a gas sensor is arranged at the bottom side of a Christmas tree ball, which reacts in case of fire or combustion gases and, in case of a fire, starts an alarm. The known Christmas ornament, however, has the disadvantage that the gas sensor is visible on the outside of the housing of the Christmas ornament, this constituting an irritating impression in the eye of the beholder. Furthermore, the known Christmas ornament is only useful as a fire alarm system, which, in case of a fallen over Christmas tree not leading to a fire, does not start an alarm.

The object of the present invention is to provide a Christmas ornament without the mentioned disadvantages.

This object is solved by a Christmas ornament with the features of claim 1. By arranging the position or inclination sensor in the housing of the Christmas ornament an acoustic and/or optical alarm can be triggered in case of a change in position or inclination of the Christmas ornament, even if no smoke or fire development is present. Thus, with a Christmas ornament according to the present invention, an alarm is started when the Christmas tree tilts, or when the Christmas ornament changes its position or inclination due to other influences, for example if a small child pulls at the branches, causing the tree to shake without actually falling over.

According to an embodiment of the invention there is provided at the (during use) bottom side of the housing of the Christmas ornament a protruding element causing an over-turning or tilting of the ornament. Hereby it can be achieved that an ornament, which has fallen off the Christmas tree, will not "stand" upright for example on a thick carpet, but will rather tilt, this leaving to a change of position or inclination of the ornament and a corresponding alarm.

In an alternative embodiment the centre of gravity of the ornament is provided in such a way that a Christmas ornament goes through a change of position or inclination during its fall from the Christmas tree. Hereby it is achieved that even during the fall of the ornament a rotation and thus a position or inclination change of the ornament is achieved, leading to the alarm being triggered. The corresponding design of the centre of gravity can for example be achieved by positioning the sensor in the housing in the upper section of the ornament, so that the centre of gravity of the ornament is off-set towards the top, whereby the ornament performs a rotational movement during its fall.

The object of the invention is furthermore achieved by a Christmas ornament with the features of claim 4. According hereto, the ornament comprises a gas sensor positioned in the inside of the housing as well as gas inlet openings in the housing, so that in case of a fire smoke and combustion gases can enter the inside of the housing via the gas inlet openings and reach the gas sensor, so that the gas sensor, in case of detecting smoke, scorching or combustion gases, can trigger an acoustical and/or optical alarm. With the Christmas ornament according to the invention the aesthetic senses of the beholder are not disturbed, as the gas inlet openings are less visible than a gas sensor or detector arranged on the outside of the housing. For example, the gas inlet openings can be made to correspond to decorative designs of the Christmas ornament in an elegant fashion. The gas sensor is preferably a ionisation gas sensor.

The object of the invention is furthermore solved by a Christmas ornament with the features of claim 6, according to which the ornament comprises in its housing at least one position or inclination sensor and at least one gas sensor, so that comprehensive safety is provided.

According to an advantageous embodiment of the invention the housing of the Christmas ornament can be opened, so that a battery provided in the housing for powering the at least one sensor is accessible and exchangeable.

According to a further embodiment of the invention the outside of the housing is provided with at least one illumination element or light emitting device to display the operating status of the battery for powering the at least one sensor, the term "operating status" comprising switching the battery on and off as well as a sufficient operating voltage of the battery. By providing such an illumination element it is made sure that the user is informed about the operability of the at least one sensor, the correct functioning of the battery and a sufficient operating voltage of the battery. The at least one illumination element can, like the gas inlet openings, also form part of the decorative design of the outside of the housing of the Christmas ornament. Furthermore, the illumination element can simultaneously serve to display the optical alarm triggered by the at least one sensor.

According to a further embodiment of the invention there is provided on or in the housing of the Christmas ornament an acoustic alarm device, especially a piezo-hooter, which can be triggered by the sensor.

It is especially advantageous to provide a reset switch for resetting a triggered acoustic and/or optical alarm with the Christmas ornament, especially on its housing. Furthermore, a test switch for testing the functionality of the acoustic and/or optical alarm is provided. According to a specially advantageous design, the reset switch and the test switch can be provided as a single switch.

Further advantages and modifications of the invention follow from the following description and the appended drawings.

Obviously, the features mentioned and now to be described are usable not only in the specifically given combinations, but also in all other combinations and individually, without leaving the scope of the present invention.

A preferred embodiment of the invention will know be described with reference to the drawings.

Figure 1:
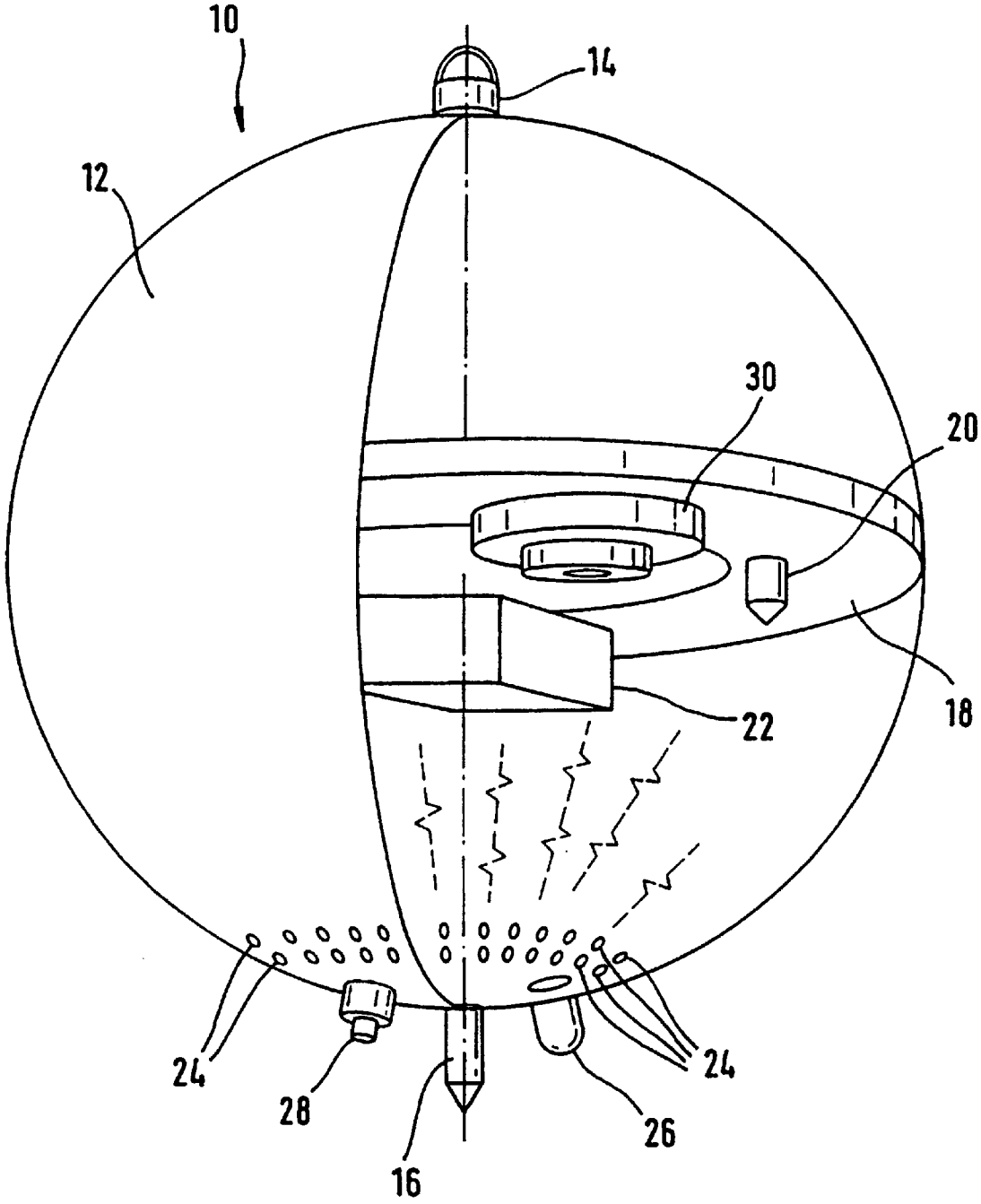
FIG. 1 shows a Christmas ornament according to the present invention in a schematic perspective view.

As a preferred embodiment of the Christmas ornament according to the present invention there is shown in FIG. 1 a Christmas tree ball 10 with a spherical housing 12, at whose upper end, as shown in FIG. 1, a lug or eyelet 14 is provided, by means of which the Christmas tree ball 10 can be hung directly or via a string on a branch or twig of a Christmas tree, which is not actually shown. The outside of the housing 12 is styled in a decorative manner, not explicitly shown in the drawing in order to present a better overview.

The housing 12 of the Christmas tree ball 10 is openable, for example by flapping open a part of the spherical housing 12. It is preferred that, in order to open the housing 12 of the Christmas tree ball 10, a quarter or a half of the housing 12 is removable. In the representation of FIG. 1 the right front quarter segment of the housing, as seen from the beholder's point of view, is broken away, so that the inside of the Christmas tree ball 10 is visible.

In the inside of the housing 12 of the Christmas tree ball an essentially horizontally arranged board 18 is arranged, on which a position or inclination sensor 20 and a gas sensor 22 as well as an acoustic alarm device 30 (alarm horn) are mounted. Obviously, the arrangement on board 18 is not limited to the horizontal arrangement shown in the figure. Rather, an arrangement of the board 18 is possible with any angle of inclination, especially a vertical arrangement.

At the lower side of housing 12, as shown in FIG. 1, gas inlet openings 24 are provided, which, in the shown preferred embodiment, have an essentially oval shape. The gas inlet openings 24 can be provided with other shapes, for example a circular shape, or be provided as slits.

Furthermore, at the lower end of the housing 12, as shown in FIG. 1, the Christmas tree ball 10 is provided with a protruding element 16, which prevents a standing of the Christmas tree ball 10 on its lower end and thus leads to a tilting of the Christmas tree ball 10, as well as an illumination element 26 and a switch 28.

Figure 2:
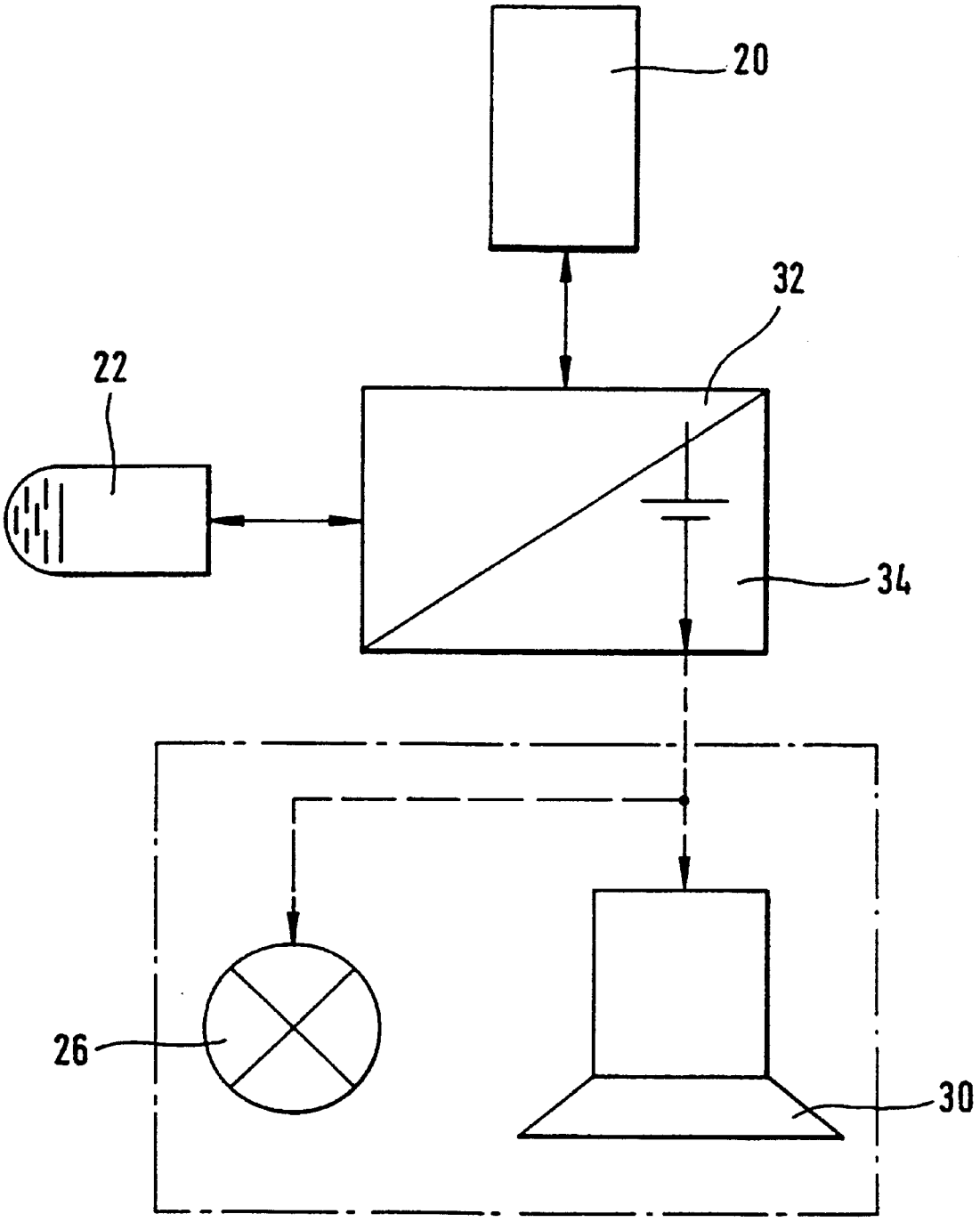
FIG. 2 shows a block diagram of the Christmas ornament of FIG. 1.

In FIG. 2 there is shown a block diagram for the individual elements of the Christmas tree ball 10 of FIG. 1. The position and inclination sensor 20 and the gas sensor 22 are connected to an exchangeable battery 32, which is preferably also mounted on the board 18. For reasons of clarity the battery 32 is not shown in FIG. 1. The battery 32 is connected to a battery monitoring device 34, which monitors the load or voltage state of the battery. The load state determined by the battery monitoring device 34 is displayed optically via the illumination element 26 and acoustically via the alarm device 30. In case of sufficient voltage of battery 32 the operability of the sensors 20, 22 is displayed by a regular short blinking of the illumination element 26. The blinking intervals can advantageously be between 30 and 60 seconds. In case the battery voltage falls under a certain threshold value, a short signal tone is given out via the acoustical alarm device 30 at regular intervals. The signal tone can also be repeated at intervals of for example 30 to 60 seconds. As after each Christmas season the tree ornaments are stowed away for a whole year, it can be prevented, by monitoring the battery 32, that when unpacking and hanging up the tree ornaments a year later, the sensors are no longer operable. Advantageously a on/off-switch is provided, by means of which the current supply of the sensors via the battery can be cut off. This can also be achieved by a further switch, which is not shown in detail. It is also possible to achieve the switching-on and switching-off of the current supply-via the battery by turning an element provided in any case, for example the eyelet 14 or the illumination element 26. The switching-off or switching-on can also be performed in that the housing 12 consists of two parts rotatable against one another, wherein in case of a rotation of the two parts against one another the current supply is provided or cut off.

During operation of the Christmas tree ball 10 according to the invention in case of smoke or fire development, corresponding smoke or combustion gases enter through the gas inlet openings 24 into the inside of the housing 12 and come into contact with the gas sensor 22, which, via the alarm horn 30, triggers an acoustical alarm, and via the illumination element 26 an optical alarm. The alarm horn 30 is preferably a 85-dezibel piezo-hooter, which gives out a loud acoustic alarm. The optical alarm display is for example achieved by means of a blinking of the illumination element 26 at short intervals.

In danger situations, which do not lead to a fire, but in which the Christmas tree, on which the Christmas tree ball 10 according to the invention is hung, starts swaying or even falls over, a changed position or inclination of the Christmas tree ball 10 is detected by means of the position or inclination sensor 20, whereby an alarm as described is started.

The triggered alarm can, in all of the described cases, be turned off by actuating the reset switch 28. Advantageously, the reset switch 28 is simultaneously a test switch 28 for testing the functionality of the sensors 20, 22 of the Christmas tree ball 10. The switching of the reset switch 28 can be designed in such a way, that the cause of the alarm (gas, change of position) must be removed within a predetermined time, for example 10 minutes. If this is not the case, the alarm starts again.

In order to secure a Christmas tree as efficiently as possible it is recommended to hang up three to four of the ornament objects according to the invention in a plane in the upper section of the Christmas tree over the circumference of the tree with regular spacing. When hanging up the ornamental objects according to the present invention, it should be made sure that these are not positioned directly over candles, especially wax candles.

Suitable gas sensors are, for example, the sensors SA308, SA318 and SA358 distributed by the company American Sensors. However, all other known sensors useful in detecting fire, smoke and gas development are usable. These sensors can especially comprise sensors based on ionisation or on photo-electrical effects.

What is claimed is:

1. An ornament for attachment to a tree comprising:

a) a housing, said housing having a spherical shape and provided with a decorative outside; and b) at least one of a position or inclination sensor provided in said housing, said at least one of a position or inclination sensor adapted to trigger at least one of an acoustical and optical alarm upon a change of at least one of position or inclination of said ornament.

2. An ornament as in claim 1 and further including:

a) a protruding element for tilting said ornament, said protruding element provided on one side of said housing, which during use is a lower side of said housing.

3. An ornament as in claim 1 and wherein said ornament having a centre of gravity such that in the event of a fall of said ornament from a tree, said ornament will be caused to change at least one of position or inclination.

4. An ornament for attachment to a tree comprising:

a) a housing, said housing having a spherical shape and provided with a decorative outside comprising gas inlet openings;

b) at least one of a position or inclination sensor provided in said housing, said at least one of a position or inclination sensor adapted to trigger at least one of an acoustical and optical alarm upon a change of at least one of position or inclination of said ornament; and c) at least one gas sensor being arranged in the housing, said at least gas sensor adapted to trigger at least one of an acoustical and optical alarm upon detection of at least one of smoke, scorching and combustion gases.

5. An ornament as in claim 1 and wherein said housing is adapted to be opened.

6. An ornament as in claim 1 and further including:

a) a battery operatively associated with said at least one of a position or inclination sensor, said battery positioned within said housing; and b) at least one illumination element provided on said outside of said housing for displaying the operating status of said battery.

7. An ornament as in claim 1 and further including:

a) an acoustic alarm device comprising a piezo-hooter, said acoustical alarm device operatively associated with said at least one of a position or inclination sensor.

8. An ornament as in claim 1 and further including:

a) at least one of a reset switch for resetting a triggered acoustical or optical alarm and a test switch for testing the functional readiness of said ornament.

9. An ornament according to claim 8 and wherein said at least one of a reset switch and a test switch comprise a single switch.

10. An ornament as in claim 4 and wherein said housing is adapted to be opened.

11. An ornament as in claim 4 and further including:

a) a battery operatively associated with said at least one of a position or inclination sensor, said battery positioned within said housing; and b) at least one illumination element provided on said outside of said housing for displaying the operating status of said battery.

12. An ornament as in claim 4 and further including:

a) an acoustic alarm device comprising a piezo-hooter, said acoustical alarm device operatively associated with said at least one of a position or inclination sensor.

13. An ornament as in claim 4 and further including:

a) at least of a reset switch for resetting a triggered acoustical or optical alarm and a test switch for testing the functional readiness of said ornament.

14. An ornament according to claim 13 and wherein said at least one of a reset switch and a test switch comprise a single switch.

15. An ornament as in claim 4 and wherein said at least one gas sensor is an ionisation gas sensor.

* * * * *